US009432776B2

(12) United States Patent
Akino

(10) Patent No.: US 9,432,776 B2
(45) Date of Patent: Aug. 30, 2016

(54) CONDENSER MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 140 days.

(21) Appl. No.: 14/466,456

(22) Filed: Aug. 22, 2014

(65) Prior Publication Data

US 2015/0110307 A1 Apr. 23, 2015

(30) Foreign Application Priority Data

Oct. 21, 2013 (JP) ..... 2013-218170

(51) Int. Cl.
*H04R 3/00* (2006.01)
*H04R 19/04* (2006.01)

(52) U.S. Cl.
CPC ..... *H04R 19/04* (2013.01)

(58) Field of Classification Search
CPC ..... H04R 19/016; H04R 19/04; H04R 3/00; H04R 3/007; H04R 2201/107; H04R 2499/11; H04R 29/003; H04R 31/006; H04R 3/002; H04R 1/06; H04R 1/08; H04R 1/1041; H04R 5/027; H04R 2201/401; H04R 2225/61; H04R 23/006; H04B 15/005; H04B 15/02; H04B 2215/061; H04M 1/6058; H04M 19/04; H04M 1/50; H04M 3/569; H04M 9/08; G10K 11/1788; G10K 2210/12; G10K 2210/3011; G10K 2210/3013; G10K 2210/3217; G10K 2210/322
USPC ..... 381/11–113, 173–175, 150; 330/277, 330/250, 278
See application file for complete search history.

(56) References Cited

U.S. PATENT DOCUMENTS 3,305,638 A * 2/1967 Teachout ..... H04R 19/04 330/277
5,579,397 A * 11/1996 Ikeda ..... H03F 3/1855 381/113
7,848,532 B2 * 12/2010 Akino ..... H04R 1/04 381/111

FOREIGN PATENT DOCUMENTS

JP 08-033090 2/1996

* cited by examiner

*Primary Examiner* — Lun-See Lao
(74) *Attorney, Agent, or Firm* — Whitham, Curtis & Cook, P.C.

(57) ABSTRACT

A condenser microphone includes a condenser microphone unit having a diaphragm and a fixed electrode disposed opposite to the diaphragm; a field effect transistor serving as an impedance converter; and a transistor to generate operational power for the field effect transistor; wherein the field effect transistor comprises a gate, a source and a drain, the gate is connected to the fixed electrode or the diaphragm, the diaphragm disposed opposite to the fixed electrode connected to the gate or the fixed electrode facing the diaphragm connected to the gate is grounded; the source is connected to a base of the transistor; the drain is connected to an emitter of the transistor; and a resistor establishing a base potential of the transistor is disposed between the base of the transistor and a ground.

5 Claims, 9 Drawing Sheets

CONDENSER MICROPHONE

TECHNICAL FIELD

The present invention relates to a condenser microphone.

BACKGROUND ART

A condenser microphone includes a condenser microphone unit having a diaphragm and a fixed electrode facing the diaphragm. The condenser microphone unit is an acoustoelectric transducer generating electrical signals converted from a variation in the electrostatic capacity of a capacitor defined by the diaphragm and the fixed electrode in response to vibrations of the diaphragm. That is, vibrations of the diaphragm due to sound waves vary the electrostatic capacity to convert the variation in the electrostatic capacity into electrical signals to be output. The condenser microphone unit therefore has a signal source impedance equivalent to the electrostatic capacity of the capacitor. As a result, the condenser microphone needs an impedance converter having extremely high input impedance at the subsequent stage of the condenser microphone unit. The impedance converter is usually composed of a field effect transistor (FET). For example, the condenser microphone unit has a fixed electrode connected to the gate of the FET and has a grounded diaphragm. Known techniques for acquiring signal output from a condenser microphone including an impedance converter having an FET include: grounding the source of the FET and acquiring signal output from the drain (refer to Japanese Unexamined Patent Application Publication No. H8-33090); and grounding the drain of the FET and acquiring signal output from the source.

The technique acquiring signal output from the drain of the FET is called a two wire system or a plug-in power system. The two wire systems are used for many simple microphones. The technique acquiring signal output from the source of the FET is called a three wire system or a source follower. The three wire system can have small distortion and a high dynamic range of output signals in comparison with the two wire system. As a result, the three wire systems are usually used for microphones for sound collection in studios.

These two techniques will now be described with reference to the accompanying drawings illustrating example circuitry. FIG. 8 is a circuit diagram illustrating an example condenser microphone of the two wire system. FIG. 9 is a circuit diagram illustrating an example three wire condenser microphone.

With reference to FIG. 8, a condenser microphone 100 of the two wire system includes a power source circuit 105 supplying operational power to a condenser microphone unit 101 and an impedance converter 102 through a single-core shielded wire 106. A power source Vcc, included in the power source circuit 105, is connected to the core wire of the single-core shielded wire 106 through a load resistor RL. A grounding line for the condenser microphone unit 101 and the impedance converter 102 is connected to a grounding line for the power source circuit 105 by the shield of the single-core shielded wire 106. In other words, the core wire of the single-core shielded wire 106 serves as both a power source line and a signal line connected to the drain of the FET in the impedance converter 102.

With reference to FIG. 9, a three wire condenser microphone 100*a* includes a power source circuit 105*a* supplying operational power to a condenser microphone unit 101 and an impedance converter 102 through a double-core shielded wire 106*a*. The power source Vcc included in the power source circuit 105*a* is connected to the drain of the FET in the impedance converter through one core wire of the double-core shielded wire 106*a*. This core wire serves as a power source line. A grounding line included in the power source circuit 105*a* is connected to the other core wire of the double-core shielded wire 106*a* through a load resistor RL. The other core wire is connected to the source of the FET in the impedance converter 102 and serves as a signal line. A grounding line for the condenser microphone unit 101 and the grounding line for the power source circuit 105*a* are connected by the shield of the double-core shielded wire 106*a*.

As illustrated in FIG. 8, a condenser microphone of a two wire system including a single-core shielded wire can be composed of a simple circuit. Unfortunately, such a condenser microphone of a two wire system acquiring signal output from the drain of the FET in the impedance converter 102 has high output impedance and often leads to distortion of signals. In comparison with the condenser microphone of the two wire system, the three wire condenser microphone illustrated in FIG. 9 has small distortion and a high dynamic range of signals in exchange for complicated circuitry. It is preferred that the two wire condenser microphone would have advantages of the three wire system exemplified in FIG. 9.

In other words, the two wire condenser microphone composed of simple circuitry should preferably have small distortion and a high dynamic range of output signals.

SUMMARY OF INVENTION

It is an object of the present invention to provide a condenser microphone of a two wire system that has simple circuitry and can output signals having small distortion and a high dynamic range.

According to an aspect of the present invention, a condenser microphone includes a condenser microphone unit having a diaphragm and a fixed electrode disposed opposite to the diaphragm; a field effect transistor serving as an impedance converter; and a transistor to generate operational power for the field effect transistor; wherein the field effect transistor comprises a gate, a source and a drain, the gate is connected to the fixed electrode or the diaphragm; the diaphragm disposed opposite to the fixed electrode connected to the gate or the fixed electrode disposed opposite to the diaphragm connected to the gate is grounded; the source is connected to a base of the transistor; the drain is connected to an emitter of the transistor; and a resistor establishing a base potential of the transistor is disposed between the base of the transistor and a ground.

The present invention can provide a condenser microphone of the two wire system that has simple circuitry and can output signals having small distortion and a high dynamic range.

DESCRIPTION OF EMBODIMENTS

Figure 1:
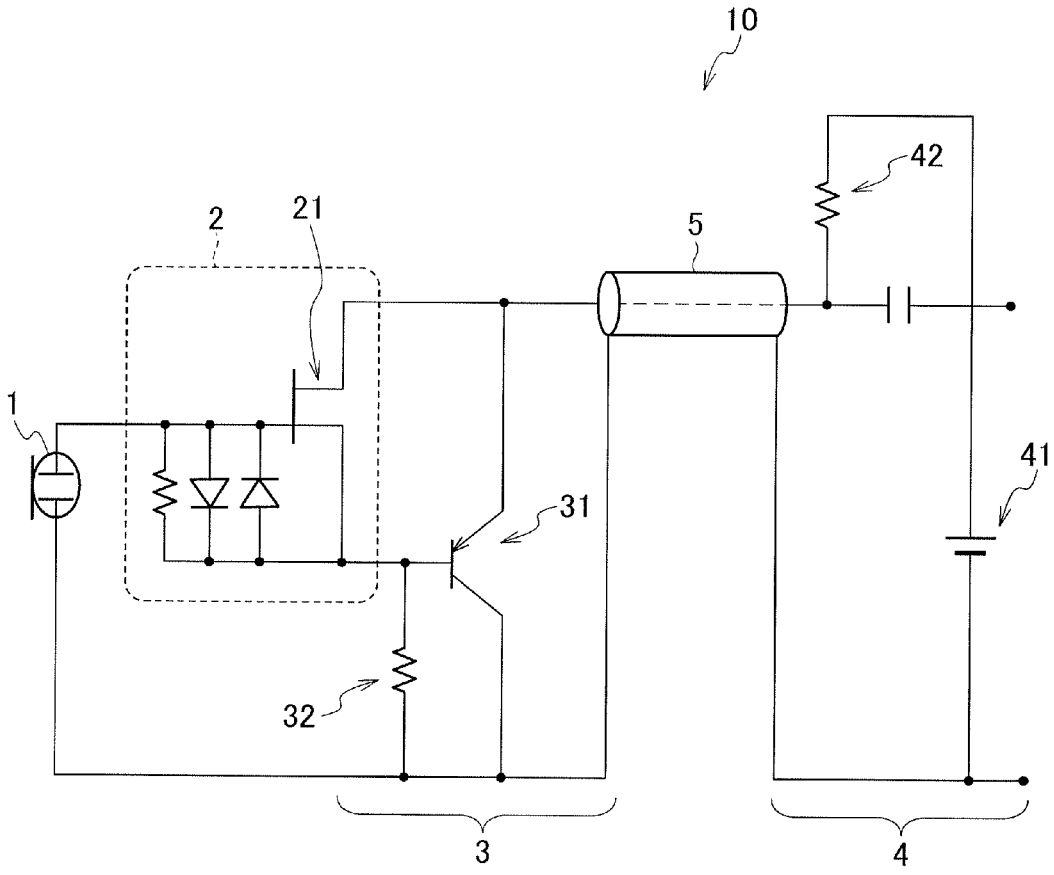
FIG. 1 is a circuit diagram illustrating a condenser microphone according to an embodiment of the present invention.

A condenser microphone according to an embodiment of the present invention will now be described with reference to the accompanying drawings. FIG. 1 is a circuit diagram illustrating the condenser microphone 10 according to the embodiment of the present invention. The condenser microphone 10 includes a condenser microphone unit 1, an impedance converter 2, and a buffer circuit 3. The condenser microphone 10 is connected to a power source circuit 4 supplying operational power through a single-core shielded wire 5.

The condenser microphone unit 1 includes a diaphragm and a fixed electrode disposed opposite to the diaphragm with a gap. The electrostatic capacity of the capacitor defined by the diaphragm and the fixed electrode varies in response to vibrations of the diaphragm caused by sound waves. A variation in the electrostatic capacity can be converted into electrical signals to be output from the condenser microphone unit 1. Since the condenser microphone unit 1 has high output impedance, the impedance converter 2 including an FET 21 having extremely high input impedance is disposed at the subsequent stage of the condenser microphone unit 1.

The condenser microphone 10 also includes the buffer circuit 3 composed of a transistor 31 and a bleeder resistor 32 downstream of the impedance converter 2. The buffer circuit 3 will be described below.

In FIG. 1, the fixed electrode of the condenser microphone unit 1 is connected to the impedance converter 2, for example. The diaphragm of the condenser microphone unit 1 is grounded. The gate of the FET 21 in the impedance converter 2 is connected to the fixed electrode of the condenser microphone unit 1 to acquire the signal output of the condenser microphone unit 1 from the drain of the FET 21.

The power source circuit 4 supplying operational power to the condenser microphone unit 1, the impedance converter 2, and the buffer circuit 3 is connected to the buffer circuit 3 through the single-core shielded wire 5. The power source 41 in the power source circuit 4 is connected to the core wire of the single-core shielded wire 5 through the load resistor 42. A grounding line for the condenser microphone unit 1, the buffer circuit 3 and a grounding line for the power source circuit 4 are connected to the shield of the single-core shielded wire 5. That is, the core wire of the single-core shielded wire 5 serves as both a power source line and a signal line.

The drain of the FET 21 is connected to the emitter of the transistor 31. The source of the FET 21 is connected to the base of the transistor 31. As a result, turning on the transistor 31 causes a forward drop voltage ($V_{BE}$) between the base and the emitter of the transistor 31 to be applied between the drain and the source of the FET 21. The voltage $V_{BE}$ is approximately 0.7 V. The voltage $V_{BE}$ serves as operational power (drain-source voltage: $V_{DS}$) for the FET 21. That is, the transistor 31 generates the voltage $V_{DS}$ serving as the operational power for the FET 21.

The buffer circuit 3 including the transistor 31 is an emitter follower circuit. Signals input from the source of the FET 21 to the base of the transistor 31 are therefore current-amplified. The buffer circuit 3 also decreases the output impedance. This operation enables the condenser microphone unit 1 to output signals, regardless of connection of the power source circuit 4 and the buffer circuit 3 through the single-core shielded wire 5.

The buffer circuit 3 includes the bleeder resistor 32 between the base of the transistor 31 and the ground in order to establish the base potential of the transistor 31. The value of the bleeder resistor 32 is determined depending on the voltage of the power source 41 included in the power source circuit 4. For example, if the power source 41 has a voltage of 9 V and a load resistor 42 of 2 kΩ, the optimum resistance of the bleeder resistor 32 is approximately 30 kΩ.

The condenser microphone 10 as described above can acquire signal output at low output impedance regardless of simple two wire circuitry. The resulting signals have small distortion and a high dynamic range.

Figure 8:
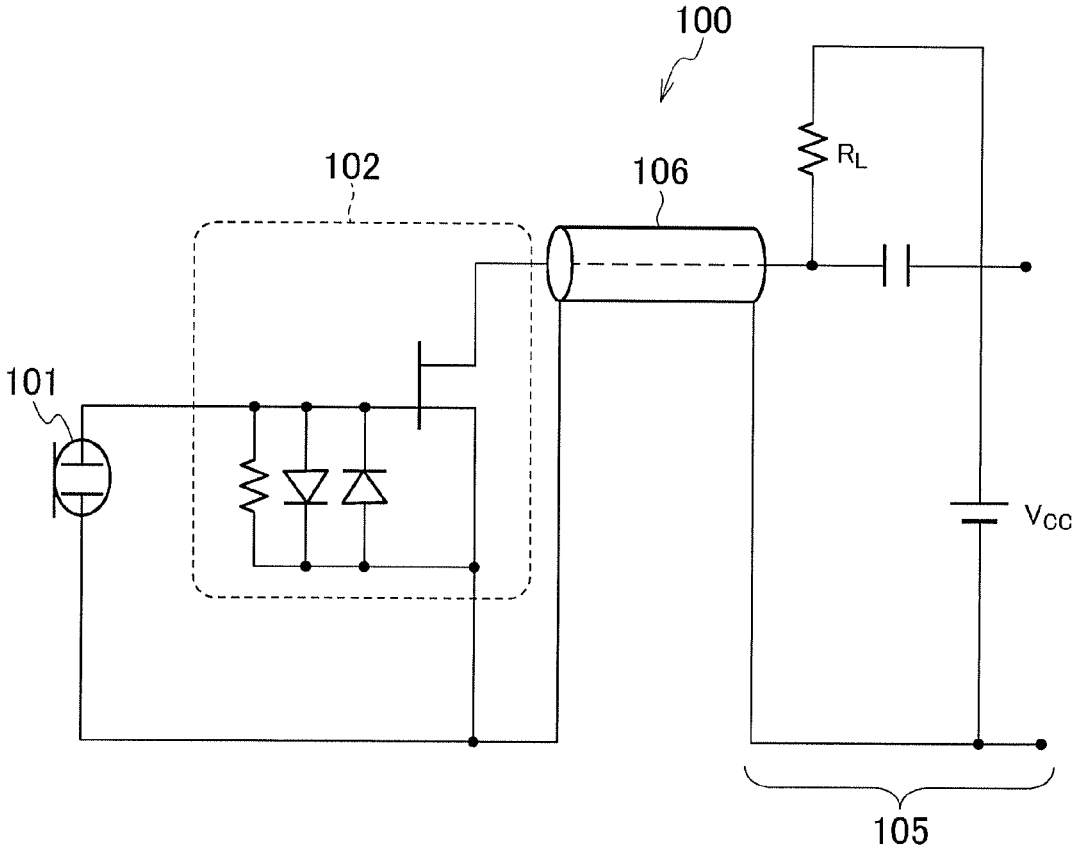
FIG. 8 RELATED ART
FIG. 8 is a circuit diagram illustrating a traditional two wire condenser microphone.
Figure 9:
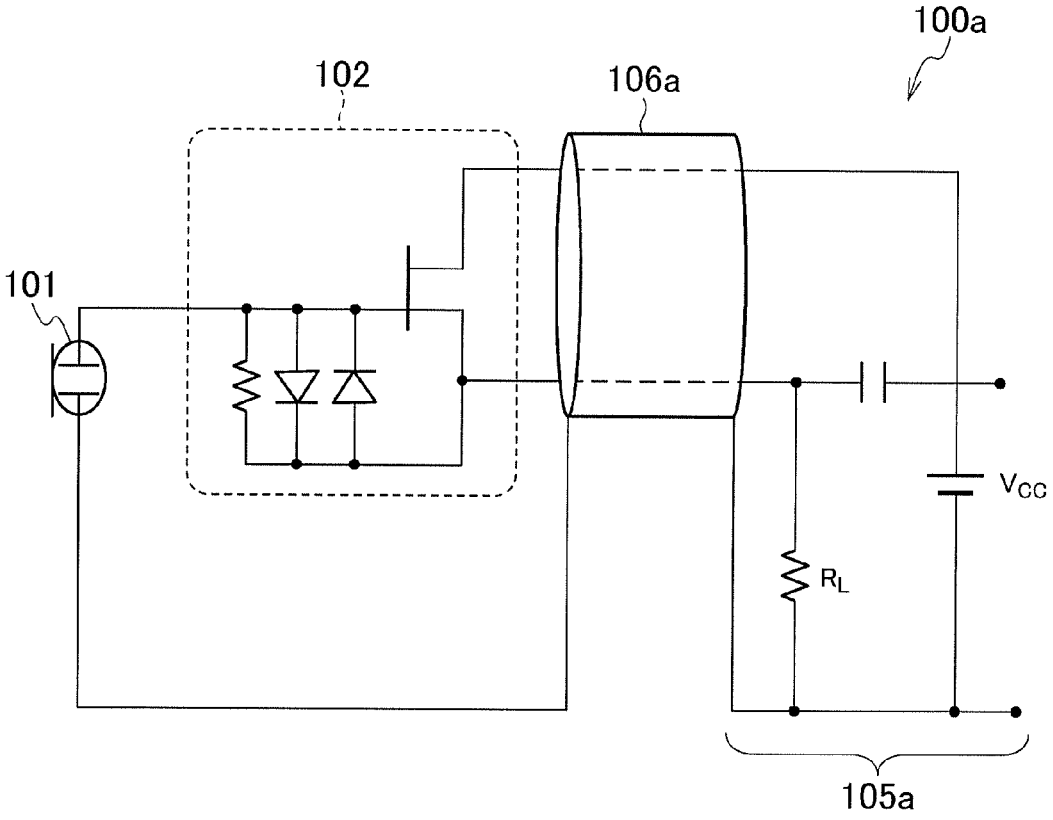
FIG. 9 RELATED ART
FIG. 9 is a circuit diagram illustrating a traditional three wire condenser microphone.

The difference in characteristics between the circuitry of the condenser microphone 10 according to the present embodiment and the typical traditional circuitry illustrated in FIG. 8 will now be explained with reference to the results measured under the same conditions. Each value of the accompanying graphs was measured with a dummy capacitor Ci instead of the condenser microphone unit and dummy input signals Vin in the circuitry of the condenser microphone 10 and the typical traditional circuitry. The dummy capacitor Ci has an electrostatic capacity of 33 pF. The input level of the dummy input signals Vin is −40 dB.

Figure 2:
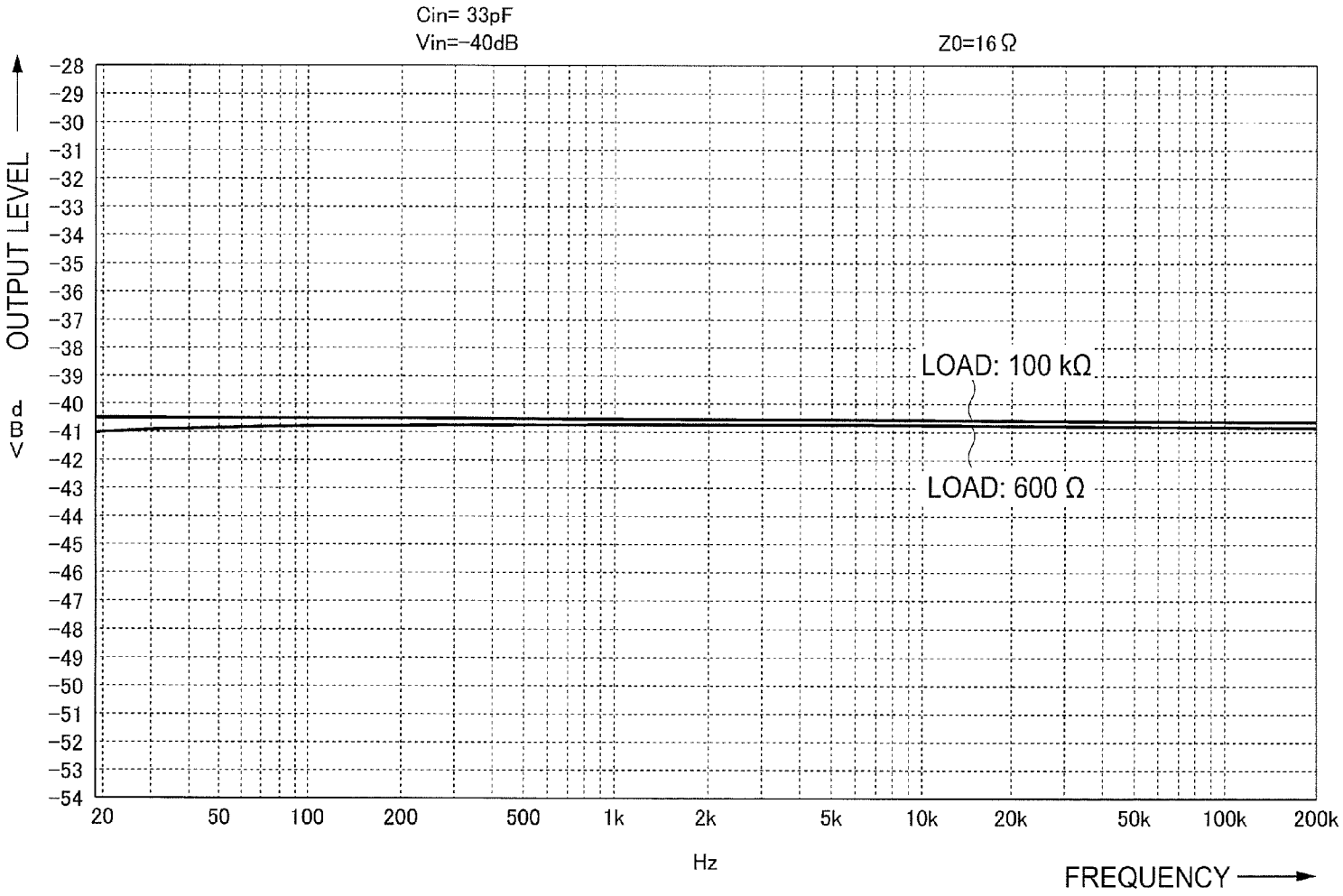
FIG. 2 is a graph illustrating typical frequency response observed with the condenser microphone.
Figure 5:
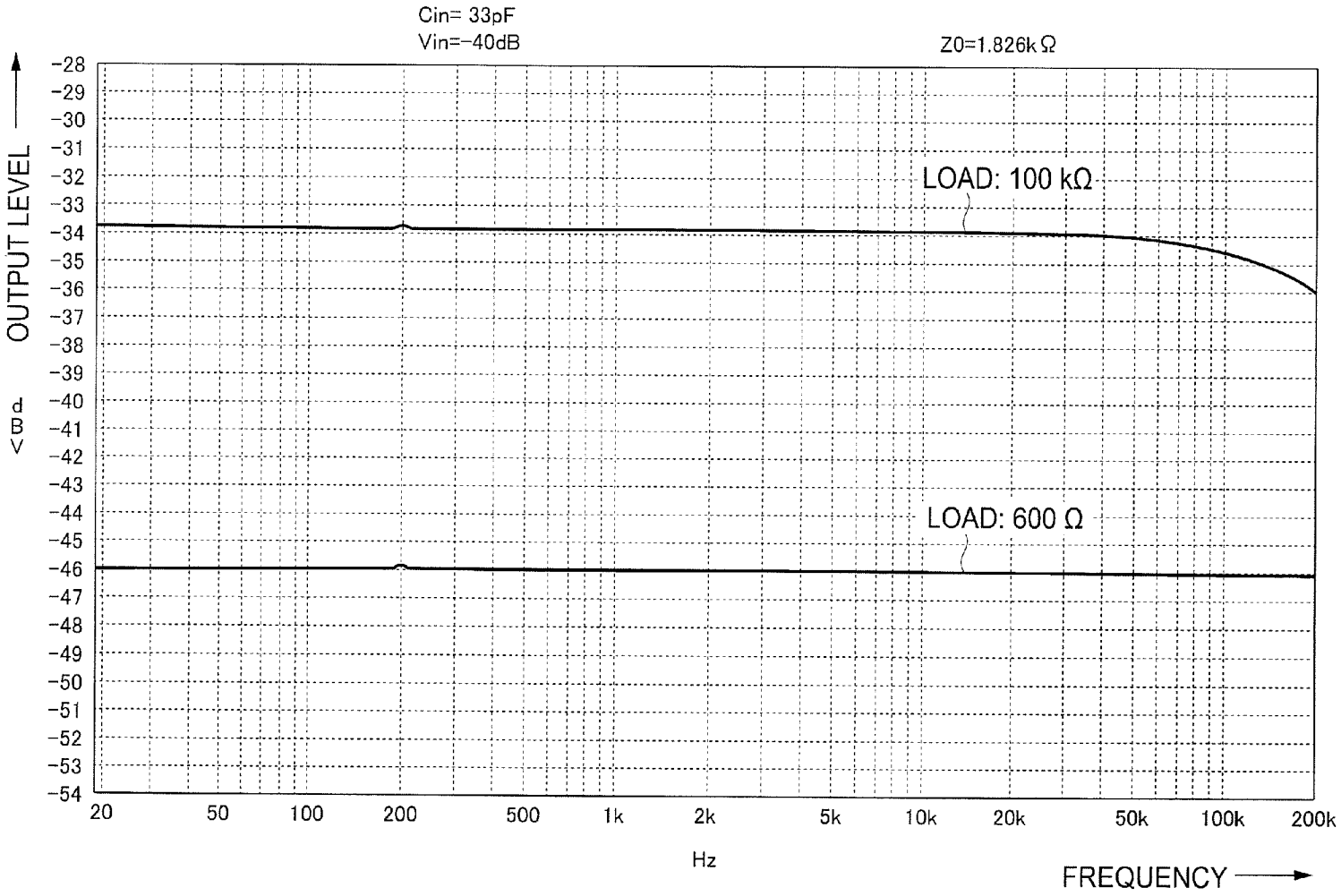
FIG. 5 RELATED ART
FIG. 5 is a graph illustrating typical frequency response observed with a traditional condenser microphone.

The frequency responses will now be compared. FIG. 2 is a graph illustrating typical frequency response observed with the condenser microphone 10. FIG. 5 is a graph illustrating typical frequency response observed with a traditional condenser microphone.

FIGS. 2 and 5 have horizontal axes representing the frequency of the dummy input signals Vin, and vertical axes representing the output level. The frequency response was measured in connecting load resistors of 100 kΩ and 600Ω.

As illustrated in FIG. 5, the traditional condenser microphone involves a large variation in the output levels depending on the magnitudes of the loads. That is, the output level under a load of 100 kΩ is approximately −34 dB. In contrast to this, the output level under a load of 600Ω is approximately −46 dB. The output level increases with an increase in the load in this way since the traditional condenser microphone has high output impedance. The calculated output impedance of the traditional condenser microphone is approximately 1.8 kΩ.

In contrast to this, the frequency response of the condenser microphone 10 according to the present embodiment has an output level of approximately −41 dB under loads of both 100 kΩ and 600Ω, as illustrated in FIG. 2. The constant output level regardless of the variable load indicates low output impedance of the condenser microphone 10. The calculated output impedance of the condenser microphone 10 is approximately 16Ω.

As described above, the condenser microphone 10 according to the present embodiment has lower output impedance than that of the traditional condenser microphone. The condenser microphone 10 according to the present embodiment also exhibits a smaller variation in the output level due to a variation in the frequency than that in the traditional condenser microphone. The output level is substantially flat from the low frequency band to the high frequency band under loads of both 100 kΩ and 600Ω.

Figure 3:
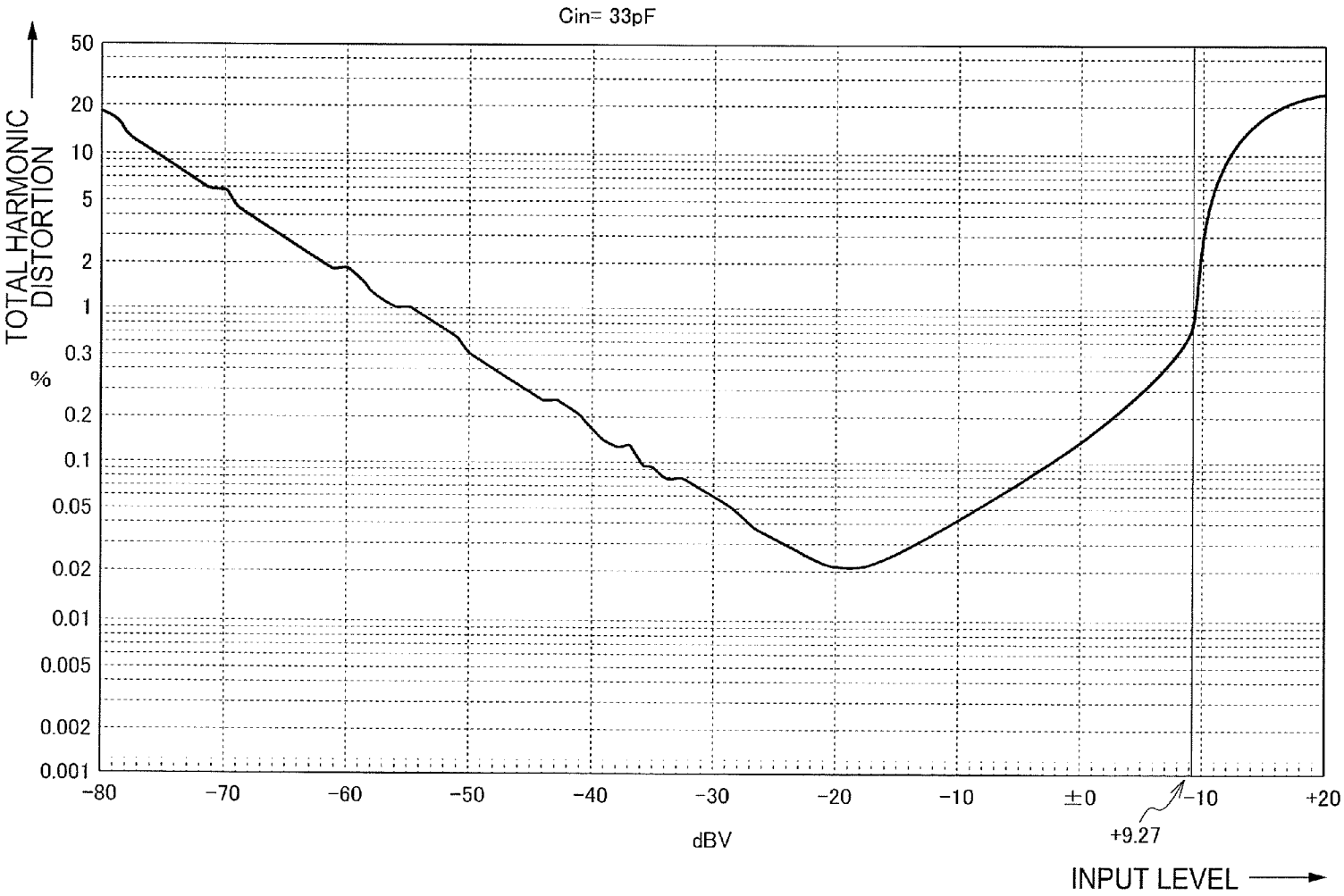
FIG. 3 is a graph illustrating typical total harmonic distortion observed with the condenser microphone.
Figure 6:
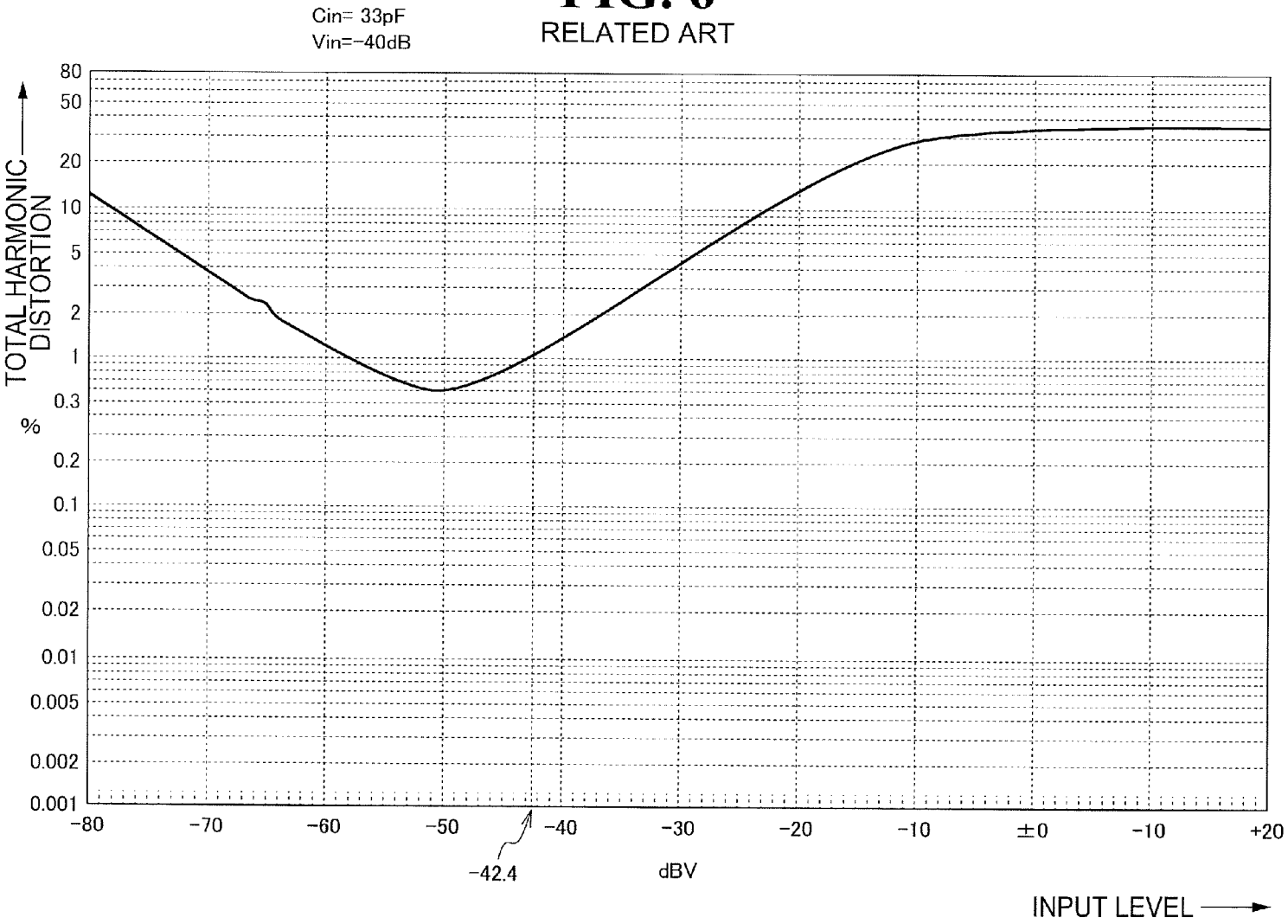
FIG. 6 RELATED ART
FIG. 6 is a graph illustrating typical total harmonic distortion observed with the traditional condenser microphone.

Next, the total harmonic distortions (THD) will be compared. FIG. 3 is a graph illustrating typical total harmonic distortion observed with the condenser microphone 10. FIG. 6 is a graph illustrating typical total harmonic distortion observed with the traditional condenser microphone. The total harmonic distortion can be used for determination of the input signal level leading to output signals having an allowable distortion rate (1%).

As illustrated in FIG. 6, in the traditional condenser microphone, the input level causing a distortion rate of 1% is −42.4 dB. Since the level of the dummy input signals Vin is −40 dB as described above, the traditional condenser microphone causes distortion of output signals in the measurement of the frequency response illustrated in FIG. 5.

In contrast to this, in the condenser microphone 10 according to the present embodiment, the input level causing a distortion rate of 1% is +9.27 dB as illustrated in FIG. 3. As a result, even larger input than that in the traditional condenser microphone by 50 dB does not cause the distortion of the output.

As described above, the condenser microphone 10 according to the present embodiment causes smaller distortion of output signals than that in the traditional condenser microphone.

Figure 4:
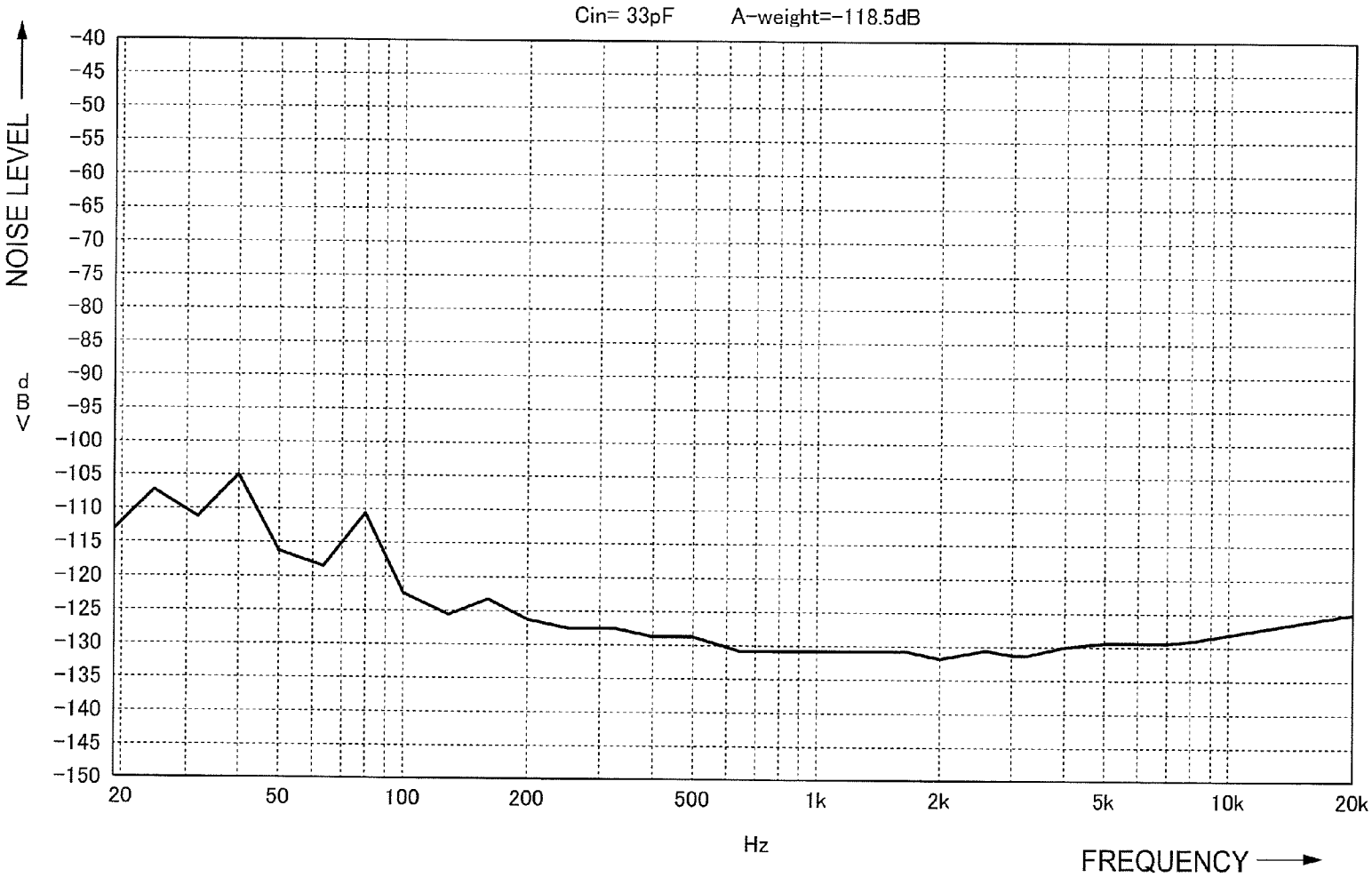
FIG. 4 is a graph illustrating a typical noise spectrum observed with the condenser microphone.
Figure 7:
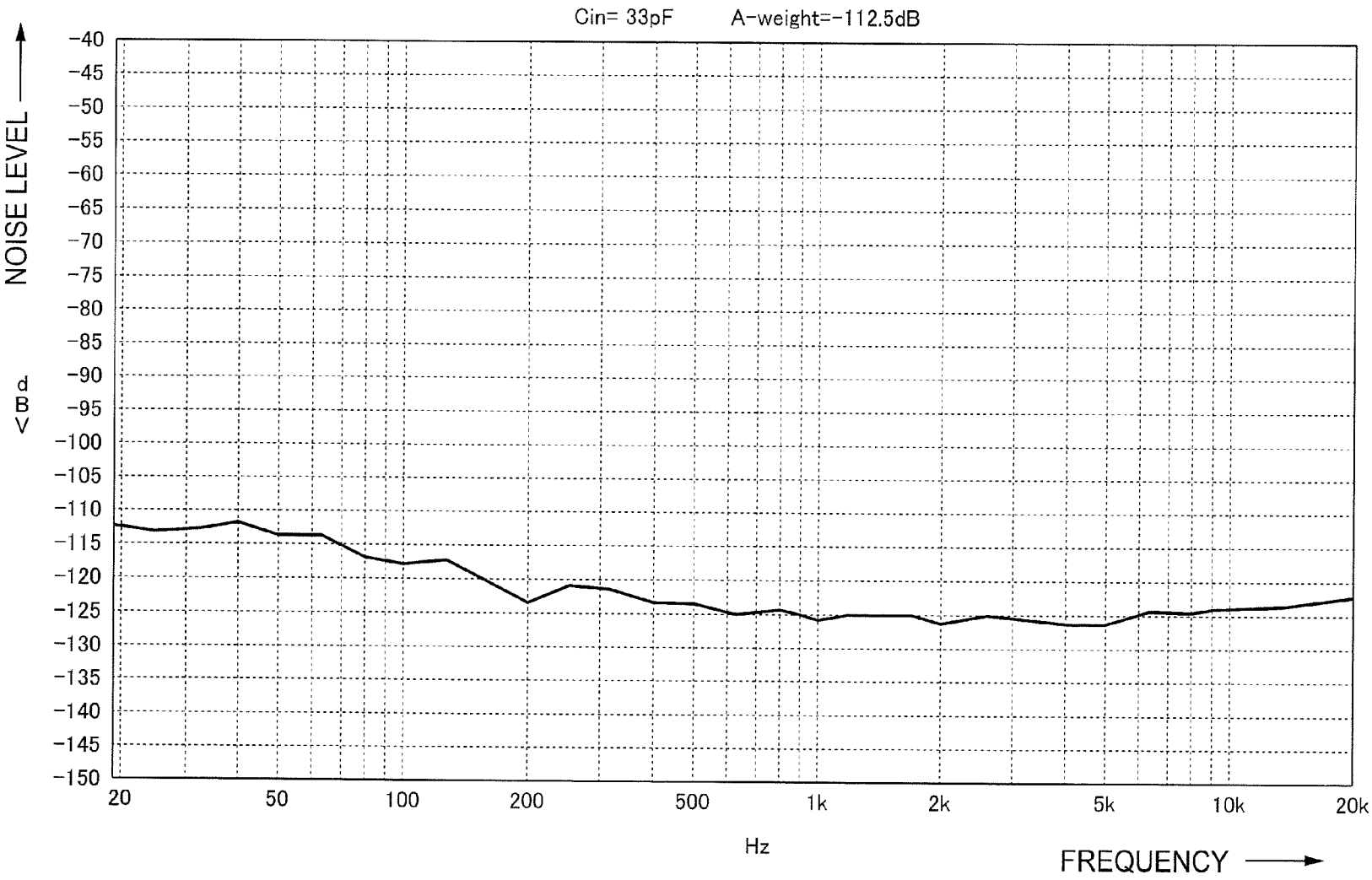
FIG. 7 RELATED ART
FIG. 7 is a graph illustrating a typical noise spectrum observed with the traditional condenser microphone.

Noise spectra will now be compared. FIG. 4 is a graph illustrating a typical noise spectrum observed with the condenser microphone 10. FIG. 7 is a graph illustrating a typical noise spectrum observed with the traditional condenser microphone.

As illustrated in FIGS. 4 and 7, the value for auditory sensation weighting (A-weighting) of the condenser microphone 10 according to the traditional condenser microphone is −112.5 dBV (FIG. 7). In contrast, the value according to the present embodiment is −118.5 dBV (FIG. 4).

The dynamic range represents the range between an input level causing a distortion rate of 1% and the value for auditory sensation weighting. That is, the dynamic range of the traditional circuitry is 70 dB (=112.5−42.4). In contrast to this, the dynamic range of the condenser microphone 10 according to the present embodiment is 127.7 dB (=118.5+9.27). As described above, the condenser microphone 10 has a high dynamic range in comparison with traditional condenser microphones.

The following Table 1 illustrates a comparison between the characteristics of the condenser microphone 10 according to the present embodiment and the traditional condenser microphone.

TABLE 1

| | Traditional condenser microphone (FIG. 8) | Present embodiment (FIG. 1) |
|---|---|---|
| Voltage gain | 6.2 dB | −0.5 dB |
| Output impedance | 1.8 kΩ | 16 Ω |
| Maximum output level (THD 1%) | −42.4 dB | +9.2 dB |
| Noise level (A-weighting) | −112.4 dB | −118.5 dB |
| Dynamic range | 70 dB | 127.7 dB |

Table 1 shows that the condenser microphone 10 according to the present embodiment has a dynamic range of 767 times based on a voltage ratio, regardless of a two wire system.

As described above, the condenser microphone 10 according to the present invention has the advantages of a three wire system, regardless of a two wire system including a single line used for both a power source line and a signal line, i.e., a plug-in power system. In other words, the condenser microphone can output signals having small distortion and a high dynamic range in spite of simple circuitry.

What is claimed is:

1. A condenser microphone comprising:

a condenser microphone unit having a diaphragm and a fixed electrode disposed opposite to the diaphragm;

a field effect transistor serving as an impedance converter; and a transistor to generate operational power for the field effect transistor, wherein the field effect transistor comprises a gate, a source and a drain, the gate is connected to the fixed electrode or the diaphragm;

the diaphragm disposed opposite to the fixed electrode connected to the gate or the fixed electrode disposed opposite to the diaphragm connected to the gate is grounded;

the source is connected to a base of the transistor;

the drain is connected to an emitter of the transistor, a resistor establishing a base potential of the transistor is disposed between the base of the transistor and a ground, output signals of the condenser microphone unit are extracted through a two wire system from the drain of the field effect transistor, and a forward drop voltage between the base and the emitter of the transistor serves as an operational power for the field effect transistor, the operational power being a drain-source voltage of the field effect transistor.

2. The condenser microphone according to claim 1, wherein the condenser microphone is supplied with the operational power through a plug-in power system including a single line used for both a power source line and a signal line.

3. The condenser microphone according to claim 1, connected to a power source circuit to supply the operational power for the field effect transistor through a single-core shielded wire.

4. The condenser microphone according to claim 3, wherein the single-core shielded wire has a core wire serving as both a power source line and a signal line.

5. The condenser microphone according to claim 3, wherein the single-core shielded wire has a shield connected to the diaphragm facing the fixed electrode connected to the gate or to the fixed electrode facing the diaphragm connected to the gate, to a grounding line for a buffer circuit including the transistor and the resistor, and to a grounding line for the power source circuit.

* * * * *